US006004672A

United States Patent [19]

Shin et al.

[11] Patent Number: 6,004,672

[45] Date of Patent: Dec. 21, 1999

[54] FIBERS FLASH-SPUN FROM BLENDS OF POLYOLEFIN POLYMERS

[75] Inventors: Hyunkook Shin, Wilmington, Del.; James Ross Waggoner, Midlothian, Va.; Sam Louis Samuels, Landenberg, Pa.; Michael Allen Bryner, Midlothian; Rudolph Francis Janis, Richmond, both of Va.

[73] Assignee: E. I. du Pont de Nemours and Company, Wilmington, Del.

[21] Appl. No.: 09/101,088

[22] PCT Filed: Jan. 9, 1997

[86] PCT No.: PCT/US97/00161

§ 371 Date: Jun. 30, 1998

§ 102(e) Date: Jun. 30, 1998

[87] PCT Pub. No.: WO97/25461

PCT Pub. Date: Jul. 17, 1997

Related U.S. Application Data

[60] Provisional application No. 60/009,739, Jan. 11, 1996.

[51] Int. Cl.[6] ..... D02G 3/00

[52] U.S. Cl. ..... 428/364; 428/357; 264/205; 264/211.14

[58] Field of Search ..... 428/364, 357; 264/205, 211.14

[56] References Cited

U.S. PATENT DOCUMENTS

| | | | |
|---|---|---|---|
| 3,081,519 | 3/1963 | Blades et al. | 28/81 |
| 3,227,784 | 1/1966 | Blades et al. | 264/53 |
| 3,227,794 | 1/1966 | Anderson et al. | 264/205 |
| 3,484,899 | 12/1969 | Smith | 18/8 |
| 3,851,023 | 11/1974 | Brethauer et al. | 264/24 |
| 4,127,623 | 11/1978 | Matsushima et al. | 264/13 |
| 4,260,565 | 4/1981 | D'Amico et al. | 264/13 |
| 5,147,586 | 9/1992 | Shin et al. | 264/13 |
| 5,192,468 | 3/1993 | Coates et al. | 264/211 |
| 5,371,810 | 12/1994 | Vaidyanathan | 382/48 |
| 5,795,651 | 8/1998 | Matsuoka et al. | 428/364 |
| 5,816,700 | 10/1998 | Starke, Sr. et al. | 366/147 |

FOREIGN PATENT DOCUMENTS

| | | | |
|---|---|---|---|
| 0 645 480 A1 | 3/1995 | European Pat. Off. | D01F 8/06 |
| 06 257 011 | 9/1994 | Japan | D01F 6/46 |
| 970070 | 9/1964 | United Kingdom . | |

*Primary Examiner*—Richard Weisberger

[57] ABSTRACT

This invention is directed to a flash spun plexifilamentary strand material comprising blends of thermoplastic material including polyethylene and polypropylene, the resulting strand has a unique morphology comprising a three dimensional integral plexus of semicrystalline fibrous elements.

10 Claims, 3 Drawing Sheets

FIBERS FLASH-SPUN FROM BLENDS OF POLYOLEFIN POLYMERS

This application claims benefit of provisional application Ser. No. 60/009/739 filed Jan. 11, 1996.

BACKGROUND OF THE INVENTION

This invention relates to fibers that are flash-spun from blends of polymers that include two or more polyolefin polymers. More particularly, the invention relates to flash-spun plexifilamentary fibers comprised of a polymer blend that includes significant polyethylene and polypropylene components.

The art of flash-spinning strands of plexifilamentary film-fibriis from polymer in a solution or a dispersion is known in the art. The term "plexifilamentary" means a three-dimensional integral network of a multitude of thin, ribbon-like, film-fibril elements of random length and with a mean film thickness of less than about 4 microns and with a median fibril width of less than about 25 microns. In plexifilamentary structures, the film-fibril elements are generally coextensively aligned with the longitudinal axis of the structure and they intermittently unite and separate at irregular intervals in various places throughout the length, width and thickness of the structure to form a continuous three-dimensional network.

U.S. Pat. No. 3,227,784 to Blades et al. (assigned to E. I. du Pont de Nemours & Company ("DuPont")) describes a process wherein a polymer in solution is forwarded continuously to a spin orifice at a temperature above the boiling point of the solvent, and at autogenous pressure or greater, and is flash-spun into a zone of lower temperature and substantially lower pressure to generate a strand of plexifilamentary material. U.S. Pat. No. 3,227,794 to Anderson et al. (assigned to DuPont) teaches that plexifilamentary film-fibrils are best obtained from solution when fiber-forming polymer is dissolved in a solvent at a temperature and at a pressure above the pressure at which two liquid phases form, which pressure is generally known as the cloud point pressure at the given temperature. This solution is passed to a pressure let-down chamber, where the pressure decreases below the cloud point pressure for the solution thereby causing phase separation. The resulting two phase dispersion of a solvent-rich phase in a polymer-rich phase is discharged through a spinneret orifice to form the plexifilamentary strand.

U.S. Pat. No. 3,484,899 to Smith (assigned to DuPont) discloses an apparatus with a horizontally oriented spin orifice through which a plexifilamentary strand can be flash-spun. The polymer strand is conventionally directed against a rotating lobed deflector baffle to spread the strand into a more planar web structure that the baffle alternately directs to the left and right as the web descends to a moving collection belt. The fibrous sheet formed on the belt has plexifilamentary film-fibril networks oriented in an overlapping multi-directional configuration.

European Patent Publication 645480 filed by Unitika Ltd. discloses a plexifilamentary fiber structure that is flash-spun from a solution of polyolefin and polyester polymers dissolved in methylene chloride. The polyolefins disclosed include polyethylene and polypropylene polymers and copolymers. The polyesters disclosed include polyethylene terephthalate and polybutylene terephthalate. The Unitika patent discloses that the mixing ratio (by weight) of the polyolefin to the polyester is from 5/95 to 95/5.

British Patent Specification 970,070 (assigned to DuPont) discloses nonwoven sheets made from fibers that were flash-spun from a blend of polyethylene and a minor amount of another polymer such as polyamide, polyvinyl chloride, polystyrene, or polyurethane. The patent suggests that a "blends of linear polyethylene and minor amounts of branched polyethylene, polypropylene, polybutylene, polyisobutylene, polybutadiene, polyvinyl chloride, or cellulose acetate" might be advantageous. However, the patent does not appear to disclose the actual flash-spinning of polyethylene and polypropylene blends.

Many improvements to the basic flash-spinning process have been reported or patented over the years. An alternative process for flash-spinning a plexifilamentary strand according to which a mechanically generated dispersion of melt-spinnable polymer, carbon dioxide and water under high pressure is flashed through a spin orifice into a zone of substantially lower temperature and pressure to form a plexifilamentary strand is disclosed in U.S. Pat. No. 5,192,468 to Coates et al. (assigned to DuPont). Flash-spinning of polyethylene to produce non-woven sheets is practiced commercially and is the subject of numerous patents, including U.S. Pat. No. 3,851,023 to Brethauer et al (assigned to DuPont).

The commercial application for flash-spinning has been primarily directed to the manufacture of sheets of bonded polyethylene plexifilaments. Polyethylene is an ideal polymer for flash-spinning. It can be flash-spun into a strong well fibrillated plexifilament over a wide range of processing conditions. However, its melting point is relatively low (~140° C.), and therefore it is not suitable for applications where end use temperatures are 140° C. or higher. One such application is steam sterilizable sterile packing, and CSR (i.e., central storage room) wraps used in the hospitals for steam sterilization. Polypropylene, on the other hand, has a higher melting point (165° C.) that is above the temperatures used during steam sterilization. However, polypropylene is more difficult to flash-spin than polyethylene and as-spun fibers are not as strong. In addition, polypropylene requires substantially higher spin temperatures than polyethylene.

There is a need for a flash-spun product that enjoys the strength and ease of processing associated with polyethylene, but that can withstand higher end use temperatures.

SUMMARY OF THE INVENTION

According to the present invention, there is provided a plexifilamentary strand having a tensile strength of at least 1 gpd and a surface area, measured by the BET nitrogen adsorption method, greater than 2 $m^2/g$ comprising a three dimensional integral plexus of semicrystalline, polymeric, fibrous elements, the elements being co-extensively aligned with the network axis and having the structural configuration of oriented film-fibrils. The film-fibrils have a mean film thickness of less than 4 microns, a median fibril width of less than 25 microns, and are comprised of at least 20% by weight of polyethylene and polypropylene, wherein the polyethylene and polypropylene each comprise at least 5% by weight of each of the film-fibrils. Preferably, the film-fibrils are comprised of at least 75% by weight of polyethylene and polypropylene, and more preferably are comprised of at least 90% by weight of polyethylene and polypropylene wherein the polyethylene and polypropylene each comprise at least 35% by weight of each of the film-fibrils.

The invention is also directed to a process for the production of flash-spun plexifilamentary film-fibril strands of a polymer that is comprised of at least 75% by weight of polyethylene and polypropylene, wherein the polyethylene and polypropylene each comprise at least 5% by weight of each of the film-fibrils. The process includes the steps of forming a spin solution of polyethylene and polypropylene polymers in a solvent and spinning the spin solution at a pressure that is greater than the autogenous pressure of the spin solution into a region of substantially lower pressure and at a temperature at least 50° C. higher than the atmospheric boiling point of the solvent. The solvent in the spin solution has an atmospheric boiling point between 0° C. and 100° C., and is comprised of at least 50% of solvents selected from the group consisting of hydrocarbons, chlorinated hydrocarbons, hydrochlorofluorocarbons and alcohols.

BRIEF DESCRIPTION OF THE DRAWINGS

The accompanying drawings, which are incorporated in and constitute a part of this specification, illustrate the presently preferred embodiments of the invention and, together with the description, serve to explain the principles of the invention.

DETAILED DESCRIPTION

Figure 1:
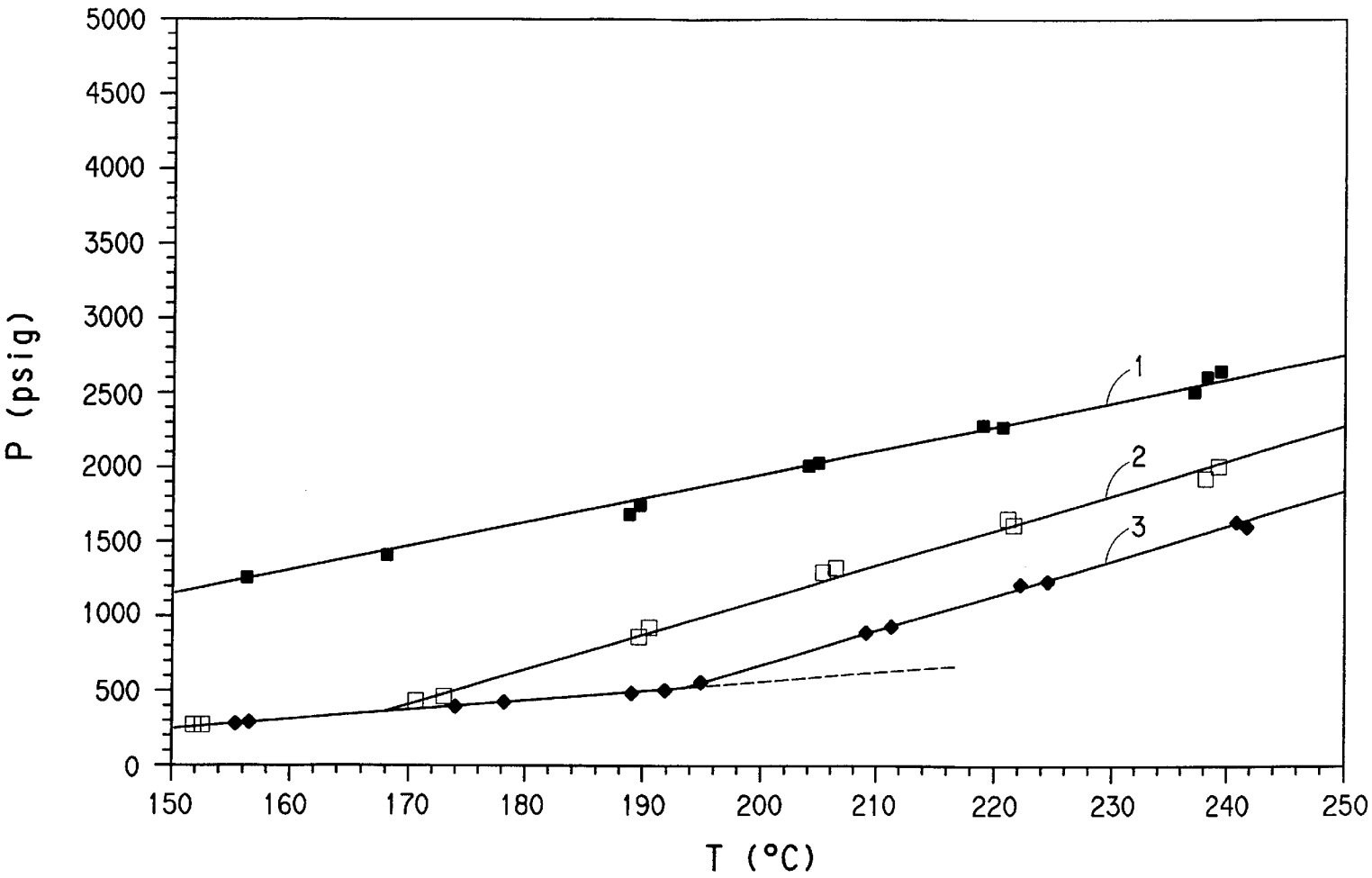
FIG. 1 is a plot of the cloud point data for 9% by weight polypropylene solution in a solvent comprised of methylene chloride and HFC-4310mee at 3 different solvent ratios.

Reference will now be made in detail to the presently preferred embodiments of the invention, examples of which are illustrated below.

The flash-spun plexifilamentary fibers of the invention are comprised of blends of thermoplastic polymers with significant polyethylene and polypropylene components. These fibers may be spun using the apparatus and the solution flash-spinning process disclosed and fully described in U.S. Pat. No. 5,147,586 to Shin et al. Alternatively, the plexifilamentary fibers of the invention can be flash-spun by the dispersion flash-spinning process disclosed in U.S. Pat. No. 5,192,468 to Coates et al., according to which a plexifilamentary fiber is spun from a mechanically generated dispersion of polymer in water and carbon dioxide. It is anticipated that in commercial applications, the plexifilamentary sheets of the invention would most likely be produced using the solution flash-spinning apparatus disclosed in U.S. Pat. No. 3,851,023 to Brethauer et al.

The process for flash-spinning plexifilaments from polyolefin polymer blends in a solvent operates under conditions of elevated temperature and pressure. The polymeric starting material is normally not soluble in the selected solvent under normal temperature and pressure conditions but forms a solution at certain elevated temperatures and pressures. In the flash-spinning process for making plexifilaments, pressure is decreased below the cloud point to cause phase separation, just before the solution is passed through a spinneret. When the solution pressure is lowered below the cloud point pressure, the solution phase separates into a polymer-rich phase and a solvent-rich phase. Upon passing through the spinneret at very high speed into a zone of substantially lower pressure, the solvent flashes off quickly such that the polymer material present in the polymer-rich phase freezes in an elongated plexifilamentary form.

The morphology of plexifilamentary strands obtained by the solution flash-spinning of a polymer is greatly influenced by the level of pressure used for spinning. When the spin pressure is much greater than the cloud point pressure of the spin mixture, coarse plexifilamentary "yarn-like" strands are usually obtained. As the spin pressure is gradually decreased, the average distance between the tie points generally becomes shorter while the fibrils of the strands become progressively finer. When the spin pressure approaches the cloud point pressure of the spin mixture, very fine fibrils are normally obtained, and the distance between the tie points becomes very short. As the spin pressure is further reduced to below the cloud point pressure, the distance between the tie points becomes longer. Well fibrillated plexifilaments, which are most suitable for sheet formation, are usually obtained when spin pressures slightly below the cloud point pressure are used. The use of pressures which are too much lower than the cloud point pressure of the spin mixture generally leads to a relatively coarse plexifilamentary structure. The effect of spin pressure on fiber morphology also depends on the types of polymers and solvents being spun and the concentration of the polymer in the solvent. At higher concentrations of polymer in the solvent, foams may be obtained rather than plexifilaments, even at spinning pressures slightly below the cloud point pressure of the solution. In some cases, well fibrillated plexifilaments can be obtained even at spin pressures slightly higher than the cloud point pressure of the spin mixture and at polymer concentrations above 20% of the spin solution. Therefore, the effect of spin pressure discussed herein is intended merely as a guide in selecting the spinning conditions and not as a general rule.

The polyethylene that has been flash-spun with polypropylene to produce the blended polyolefin polymer plexifilaments of the invention is high density polyethylene. However, it is anticipated that other types of polyethylene, including low density polyethylene and linear low density polyethylene, could be used in making the polyolefin blend plexifilaments of the invention. The polypropylene that has been flash-spun with polyethylene to produce the blended polyolefin plexifilaments of the invention is isotactic polypropylene and syndiotactic polypropylene.

While the temperature and pressure conditions that can be withstood by solution flash-spinning equipment are quite broad, it is generally preferred not to operate under extreme temperature and pressure conditions. The preferred temperature range for solution flash-spinning the blends of polyethylene and polypropylene is about 150° to 250° C. while the preferred pressure range for flash-spinning such blends is in the range of autogenous pressure to 50 MPa, and more preferably in the range of autogenous pressure to 25 MPa. Therefore, if plexifilaments are to be flash-spun from blends of polyethylene and polypropylene from a solution, the solvent should dissolve the polymers at pressures and temperatures within the preferred ranges.

Unfortunately, it has proved to be very difficult to flash-spin polypropylene plexifilamentary fibers from many common solvents, including room temperature boiling hydrocarbon solvents and strong solvents such as methylene chloride, dichloroethane and cyclopentane. We have now found that polypropylene plexifilaments can be flash-spun if the polypropylene is blended with polyethylene in sufficient quantities and/or the strong solvents are blended with weaker solvents. Interestingly, we have found that many blends of polyethylene and polypropylene cannot be flash-spun from many of the important flash-spinning solvents. For example, attempts to flash-spin a blend of 75% polypropylene and 25% polyethylene from methylene chloride blended with a weaker solvent were unsuccessful.

Polyethylene and polypropylene do not form a compatible polymer blend within the range of useful blend ratios (e.g. from 5/95 to 95/5). Consequently, solutions of polyethylene and polypropylene become cloudy when they are dissolved together in a common solvent. For example, polyethylene solutions in 80/20 methylene chloride/HFC-4310mee form a clear, single phase solution as long as pressure applied to the solution at any given temperature is higher than the cloud point pressure of the solution. Likewise, polypropylene solutions in 80/20 methylene chloride/HFC-4310mee form a clear, single phase solution as long as pressure applied to the solution is higher than the cloud point pressure. However, if both polyethylene and polypropylene are added to the same common solvent, the solution will not be a clear, single phase solution regardless of the temperature and pressure applied (within a reasonable range). Instead, the solutions will become cloudy since polyethylene is not compatible with polypropylene.

Therefore, there is no cloud point pressure for solutions of polyethylene and polypropylene blends in a common solvent. Such blends always exist as a dispersion in a phase-separated state. Consequently, when blends of polyethylene and polypropylene are flash-spun using a common solvent, cloud point pressure of individual components present in the "solution" is used. In the case of polyethylene and polypropylene blends, polyethylene always gives higher cloud point pressures than polypropylene. Thus, the blends are mixed at a pressure higher than the cloud point pressure of polyethylene, and optimum spin pressures are determined empirically. However, it has been found that optimum spin conditions for the blends are usually closer to the polyethylene spin conditions than to the polypropylene spin conditions.

Good solvents for solution flash-spinning polyethylene and polypropylene polymer blends are generally similar to those used for flash-spinning polyethylene. However, it is more difficult to select a proper flash-spinning agent for the blends, because the spin agent to be used has to satisfy both of the components present in the blends. Mixed solvent systems have been found to be particularly suited for flash-spinning polyethylene/polypropylene polymer blends, because solvent power can be adjusted to satisfy both blend components by changing the solvent ratio. Solvents that may be used for flash-spinning blends of polyethylene and polypropylene include mixtures containing as a major component hydrocarbons, chlorinated hydrocarbons, hydrochlorofluorocarbons or certain types of alcohols. Preferred solvents for solution flash-spinning blends of polyethylene and polypropylene include mixed solvent systems based on methylene chloride, dichloroethylene, cyclopentane, pentane, HCFC-141b, and bromochloromethane. Co-solvents that can be used in conjunction with these main solvents to improve electrostatic charging and/or to reduce solvent power include hydrofluorocarbons such as HFC-4310mee, hydrofluoroethers such as methyl(perfluorobutyl) ether, and perfluorinated compounds such as perfluoropentane and perfluoro-N-methylmorpholine.

The apparatus and procedure for determining the cloud point pressures of a polymer/solvent combination are those described in the above cited U.S. Pat. No. 5,147,586 to Shin et al.

FIG. 1 is a plot of the cloud point data for a 9% by weight polypropylene solution in a solvent comprised of methylene chloride and HFC-4310mee at 3 different solvent ratios (60/40, curve 1; 70/30, curve 2; and 80/20, curve 3).

Figure 2:
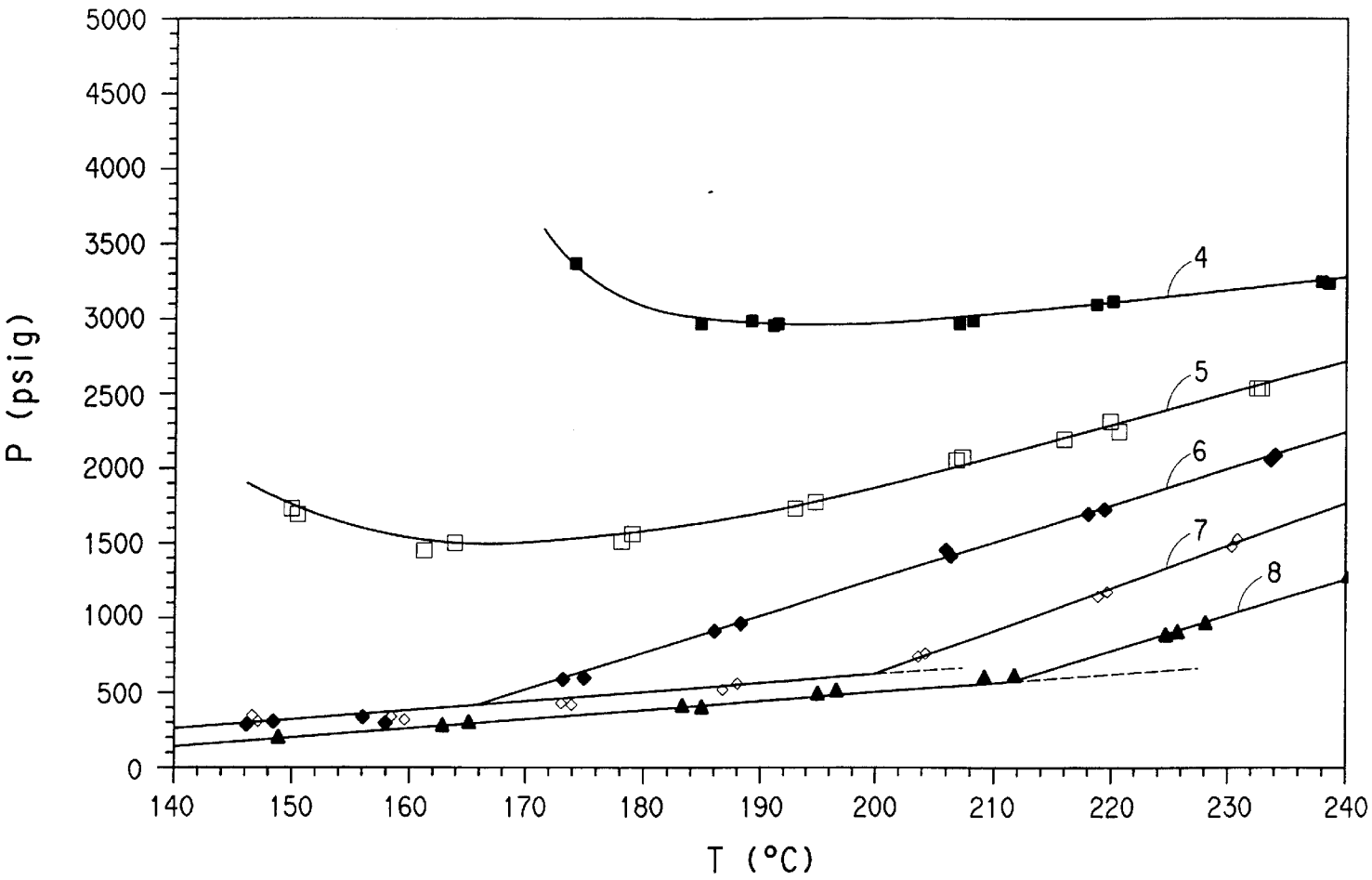
FIG. 2 is a plot of the cloud point data for a 12% by weight polyethylene solution in a solvent comprised of methylene chloride and HFC-4310mee at 5 different solvent ratios.

FIG. 2 is a plot of the cloud point data for a 12% by weight polyethylene solution in a solvent comprised of methylene chloride and HFC-4310mee at 5 different solvent ratios (75/25, curve 1; 80/20, curve 2; 85/15, curve 3; 90/10. curve 4; and 100/0, curve 5).

Figure 3:
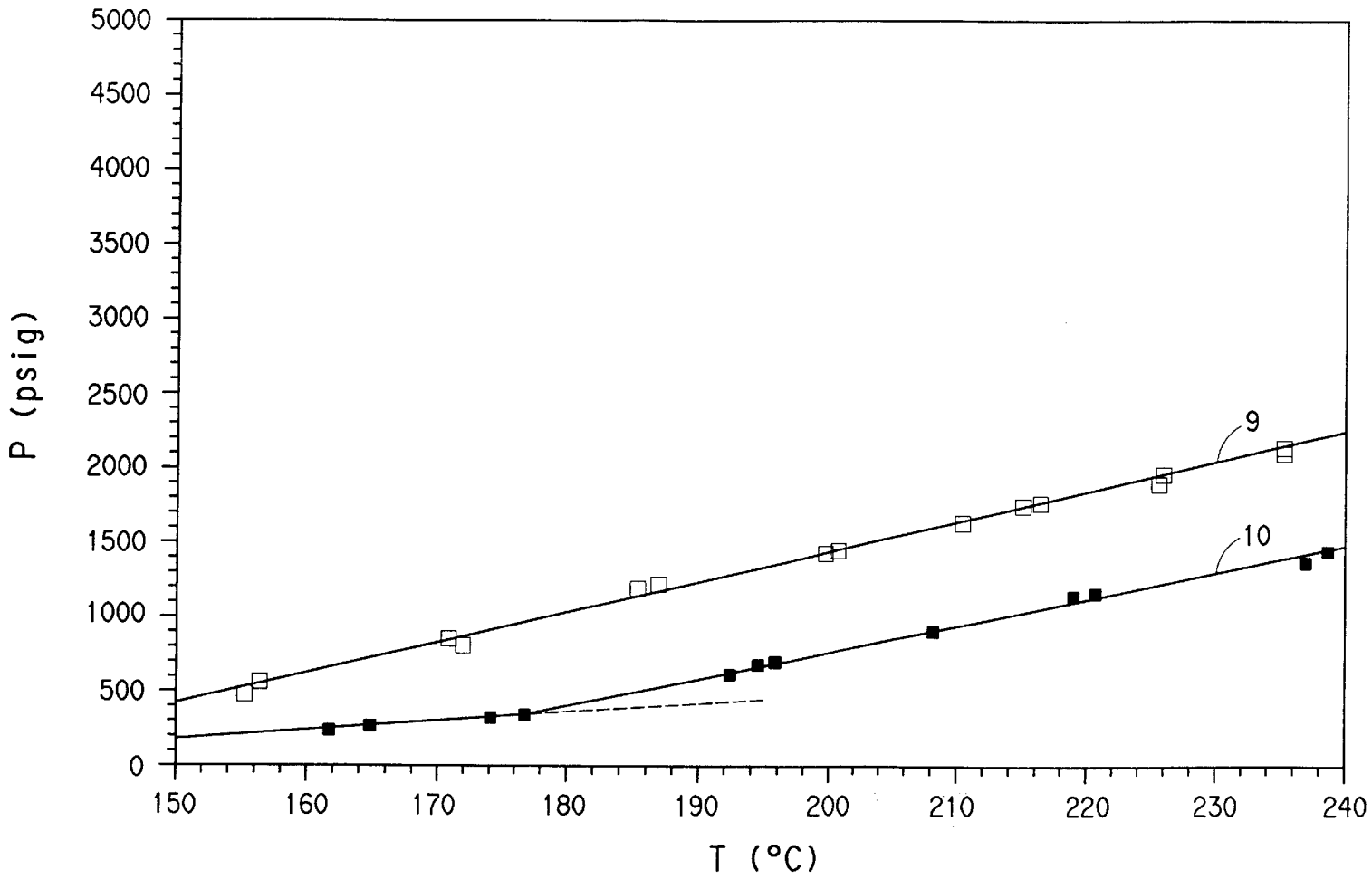
FIG. 3 is a plot of the cloud point data for 1) a 20% by weight polyethylene solution in a solvent comprised of 60140 n-pentane/82.5% pure cyclopentane, and 2) a 12% by weight polypropylene solution in a solvent comprised of 60/40 n-pentane/82.5% pure cyclopentane.

FIG. 3 is a plot of the cloud point data for (1) a 20% by weight polyethylene solution in a solvent comprised of 60/40 n-pentane/82.5% pure cyclopentane, curve 1; and (2) a 12% by weight polypropylene solution in a solvent comprised of 60/40 n-pentane/82.5% pure cyclopentane, curve 2.

This invention will now illustrated by the following non-limiting examples which are intended to illustrate the invention and not to limit the invention in any manner.

EXAMPLES

Test Methods

In the description above and in the non-limiting examples that follow, the 30 following test methods were employed to determine various reported characteristics and properties. ASTM refers to the American Society of Testing Materials, and TAPPI refers to the Technical Association of the Pulp and Paper Industry.

The denier of the strand is determined from the weight of a 15 cm sample length of strand.

Tenacity, elongation and toughness of the flash-spun strand are determined with an Instron tensile-testing machine. The strands are conditioned and tested at 70° F. and 65% relative humidity. The strands are then twisted to 10 turns per inch and mounted in the Jaws of the Instron Tester. A two-inch gauge length was used with an initial elongation rate of 4 inches per minute. The tenacity at break is recorded in grams per denier (gpd). The elongation at break is recorded as a percentage of the two-inch gauge length of the sample. Toughness is a measure of the work required to break the sample divided by the denier of the sample and is recorded in gpd. Modulus corresponds to the slope of the stress/strain curve and is expressed in units of gpd.

Fiber quality is evaluated using a subjective scale of 0 to 3, with a 3 being the highest quality rating. Under the evaluation procedure, a 10 inch length of a plexifilamentary strand is removed from a fiber batt. The web is spread and mounted on a dark substrate. The fiber quality rating is an average of three subjective ratings, one for fineness of the fiber (finer fibers receive higher ratings), one for the continuity of the fiber strand (continuous plexifilamentary strands receive a higher rating), and the other for the frequency of the ties (more networked plexifilamentary strands receive a higher rating).

Fiber fineness is measured using a technique similar to that disclosed in U.S. Pat. No. 5,371,810 to A. Ganesh Vaidyanathan dated Dec. 6, 1994, and which is hereby incorporated by reference. This technique quantitatively analyzes fibril size in webs of fiber. The webs are opened up by hand and imaged using a microscopic lens.

The image is then digitized and computer analyzed to determine the mean fibril width and standard deviation. However, some smaller fibrils may be so tightly bunched together and have such short fibril length, that the fibrils appear as part of a large fibril and are counted as such. Tight fibril bunching and short fibril length (distance from tie point to tie point) can effectively prevent analysis of the fineness of individual fibrils in the bunched fibrils. Thus, the term "apparent fibril size" is used to describe or characterize fibers of plexifilamentary strands.

The surface area of the plexifilamentary film-fibril strand product is another measure of the degree and fineness of fibrillation of the flash-spun product. Surface area is measured by the BET nitrogen absorption method of S. Brunauer, P. H. Emmett and E. Teller, J. Am. Chem. Soc., V. 60 p 309–319 (1938) and is reported as $m^2/g$.

Test Apparatus for Examples 1–7

The apparatus used in the examples 1–7 is the spinning apparatus described in U.S. Pat. No. 5,147,586. The apparatus consists of two high pressure cylindrical chambers, each equipped with a piston which is adapted to apply pressure to the contents of the chamber. The cylinders have an inside diameter of 1.0 inch (2.54 cm) and each has an internal capacity of 50 cubic centimeters. The cylinders are connected to each other at one end through a 3/32 inch (0.23 cm) diameter channel and a mixing chamber containing a series of fine mesh screens that act as a static mixer. Mixing is accomplished by forcing the contents of the vessel back and forth between the two cylinders through the static mixer. A spinneret assembly with a quick-acting means for opening the orifice is attached to the channel through a tee. The spinneret assembly consists of a lead hole of 0.25 inch (0–63 cm) diameter and about 2.0 inch (5.08 cm) length, and a spinneret orifice with both a length and a diameter shown in the table below. Orifice measurements are expressed in mils [1 mil=0.0254 mm]. In Example 4, a cylindrical tunnel was located at the exit of the spin orifice. The diameter of the tunnel was 200 mils and the length was 100 mils. The tunnel was used in order to obtain a more columnar jet of flash-spun material. The pistons are driven by high pressure water supplied by a hydraulic system.

In the tests reported in Examples 1–7, the apparatus described above was charged with pellets of a polyethylene and polypropylene polymer and a solvent. The polyethylene was high density polyethylene (HDPE) with a melt index of 0.75, a density of 0.957, a number average molecular weight of 21,000 and a weight average molecular weight of 121,000. The polypropylene was isotactic polypropylene with a melt index of 0.9 and a number average molecular weight of 95,000 and a weight average molecular weight of 431,000. High pressure water was used to drive the pistons to generate a mixing pressure of between 1500 and 3000 psi (10,340–10,680 kPa). The polymer and solvent were next heated to mixing temperature and held at that temperature for about an hour during which time the pistons were used to alternately establish a differential pressure of about 50 psi (345 kPa) or higher between the two cylinders so as to repeatedly force the polymer and solvent through the mixing channel from one cylinder to the other to provide mixing and effect formation of a spin mixture. The spin mixture temperature was then raised to the final spin temperature, and held there for about 15 minutes to equilibrate the temperature, during which time mixing was continued. In order to simulate a pressure letdown chamber, the pressure of the spin mixture was reduced to a desired spinning pressure just prior to spinning. This was accomplished by opening a valve between the spin cell and a much larger tank of high pressure water ("the accumulator") held at the desired spinning pressure. The spinneret orifice is opened about one to five seconds after the opening of the valve between the spin cell and the accumulator. This period roughly corresponds to the residence time in the letdown chamber of a commercial spinning apparatus. The resultant flash-spun product is collected in a stainless steel open mesh screen basket. The pressure recorded just before the spinneret using a computer during spinning is entered as the spin pressure.

The experimental conditions and the results for Examples 1–7 are given below in the Table 1. All the test data not originally obtained in the SI system of units has been converted to the SI units.

TABLE 1

| | POLYMER | | | SOLVENT | | | MIXING | | | SPINNING | | | Propertes @ 10TPI | | | | | |
|---|---|---|---|---|---|---|---|---|---|---|---|---|---|---|---|---|---|---|
| Ex No. | Name | P/P % | Wt % | 1 | 2 | S1/S2 Wt % | ° C. | Min | Press MPa | Orifice (tunnel) mils | Press MPa | ° C. | Den | Mod gpd | Ten gpd | E % | BET SA | Type |
| 1 | HDPE PP | 50 50 | 12 | CH2Cl2 | HFC-43-10mee | 80/20 | 210 | 40 | 20.7 | 30 × 30 | 12.6 | 210 | 172 | 6.6 | 3.6 | 60 | 17 | plex |
| 2 | HDPE PP | 75 25 | 12 | CH2Cl2 | HFC-43-10mee | 80/20 | 210 | 40 | 20.7 | 30 × 30 | 10.1 | 210 | 200 | 5.1 | 3.4 | 63 | 23 | plex |
| 3 | HDPE PP | 50 50 | 18 | n-Pentane | NONE | 100/0 | 190 | 40 | 20.7 | 30 × 30 | 15.5 | 194 | 285 | 2.4 | 1.7 | 72 | 13 | plex |
| 4 | HDPE PP | 50 50 | 18 | n-Pentane | NONE | 100/0 | 200 | 30 | 20.7 | 30 × 30 (200 × 100) | 12.6 | 198 | 250 | 3.5 | 1.4 | 60 | nm | plex |
| 5 | HDPE PP | 50 50 | 18 | n-Pentane | NONE | 100/0 | 200 | 30 | 20.7 | 30 × 30 | 14.8 | 201 | 376 | 2.1 | 1.1 | 72 | nm | plex |
| 6 | HDPE PP | 40 60 | 18 | n-Pentane | NONE | 100/0 | 220 | 30 | 24.1 | 30 × 30 | 15.9 | 218 | 301 | 1.1 | 0.8 | 69 | nm | plex |
| 7 | HDPE PP | 50 50 | 18 | n-Pentane | 82% Pure Cyclo-pentane | 60/40 | 200 | 60 | 17.2 | 30 × 30 | 11.4 | 200 | 293 | 2.8 | 2.5 | 83 | 16 | plex |

footnote: nm = not measured

Test Apparatus for Examples 8–11

In Examples 8–11, plexifilaments were spun from a spin mixture that comprised a polymer blends dispersed in a solvent system. The spin mixture, was generated in a continuous rotary mixer, as described in U.S. patent application Ser. No. 60/005,875. The mixer operated at temperatures up to 300° C. and at pressures up to 41,000 kPa. The mixer had a polymer inlet through which a polymer melt blend was continuously introduced into the mixer. The mixer also had a $CO_2$ inlet through which supercritical $CO_2$ was continuously introduced into the polymer stream entering the mixer before the polymer entered the mixing chamber of the mixer. The mixer had a mixing chamber where polymer and $CO_2$ were thoroughly sheared and mixed by a combination of rotating and fixed cutting blades. The mixer further included an injection port through which water was introduced into the mixing chamber at a point downstream of where the polymer and $CO_2$ were initially mixed in the mixing chamber. At least one additional set of rotating and fixed cutting blades in the mixing chamber further mixed the polymer, $CO_2$ and water before the mixture was continuously discharged from the mixer's mixing chamber. The volume of the mixer's mixing chamber between the point where the polymer first contacts $CO_2$ plasticizing agent and the mixer outlet was 495 cm.

The mixer was operated at a rotational rate of approximately 1200 rpm with power of between 7 and 10 kW. Polymer was injected into the mixer by a polymer screw extruder and gear pump. Supercritical $CO_2$, plasticizing agent from a pressurized storage tank and distilled water from a closed storage tank were both injected into the mixer by double acting piston pumps. A dispersion of polymer, supercritical $CO_2$ and water was generated in the mixer's mixing chamber. The spin mixture was discharged from the mixer and passed through a heated transfer line to a round spin orifice from which the mixture was flash-spun into a zone maintained at atmospheric pressure and room temperature. The residence time of the polymer in the mixer's mixing chamber was generally between 7 and 20 seconds. Unless stated otherwise, the spinning temperature was approximately 240° C. and the spinning pressure was approximately 28,900 kPa. The spin products were collected on a moving belt from which samples were removed for examination and testing.

The following polymers were flash-spun in examples 8–11. The percentages stated in the examples are by weight unless otherwise indicated.

Each ingredient has been assigned a code by which it is referred to in examples 8–11.

The polyethylene used in the following Examples was ALATHON® H6018, a high density polyethylene that was obtained from Occidental Chemical Corporation of Houston, Tex. and its successor in interest Lyondell Petrochemical Company of Houston, Tex. ALATHON® is currently a registered trademark of Lyondell Petrochemical Company. ALATHON® H6018 has a melt flow rate of 18 g/10 min by standard techniques at a temperature of 190° C. with a 2.16 Kg weight, and has a melting point of 130–135° C. ("PE").

The polypropylene used in the following Examples was Valtec HH444 obtained from Himont Corporation of Wilmington, Del. Valtec HH444 has a melt flow rate of 70g/10 min by standard techniques at a temperature of 190° C. with a 2.16 kg weight, and has a melting point of 170° C. ("PP").

One 4GT polyester used in the following examples was CRASTIN® 6131 obtained from DuPont of Wilmington, Delaware. CRASTIN® is a registered trademark of DuPont. CRASTIN® 6131 was formerly sold under the name RYNITE® 6131. CRASTIN® 6131 is a non-reinforced low molecular weight 4GT polyester. CRASTIN® 6131 has a melt flow rate of 42g/10 min by standard techniques at a temperature of 250° C. with a 2.16 kg weight, and has a melting point of 225° C. ("4GT-6131").

Another 4GT polyester used in the following examples was CRASTIN® 6130 obtained from DuPont of Wilmington, Del. CRASTIN® 6130 is a non-reinforced 4GT polyester with a higher molecular weight than CRASTIN® 6131. CRASTIN® 6130 has a melt flow rate of 12.5 g/10 min by standard techniques at a temperature of 250° C. with a 2.16 kg weight, and has a melting point of 225° C. ("4GT-6130").

The polyester elastomer used in the following examples was HYTREL® 6133, a melt spinnable block copolymer obtained from E. I. du Pont de Nemours and Co. of Wilmington, Del. HYTREL® is a registered trademark of DuPont. HYTREL® has a melt flow rate of 5.0 g/10 min by standard techniques at a temperature of 190° C. with a 2.16 kg weight, and it has a melting point in the range of 170–190° C. ("PEL").

The partially neutralized ethylene vinyl alcohol copolymer used in the following examples was SELAR® OH BX240 obtained from E. I. du Pont de Nemours and Co. of Wilmington, Del. SELAR® is a registered trademark of DuPont. SELAR® OH BX240 is a melt-blended, pelletized polymer consisting of 90% SELAR® OH 4416 and 10% FUSABOND™ E MB-259D, both polymers being obtained from DuPont of Wilmington, Delaware. SELAR® OH 4416 is an ethylene vinyl alcohol copolymer having 44 mole % ethylene units, a melt flow rate of 16.0 g/10 min by standard techniques at a temperature of 210° C. with a 2.16 kg weight, and a melting point of 168° C. FUSABOND™ E MB-259D is a polyethylene grafted with 0.2–0.3% maleic anhydride, having a melt flow rate of 20–25 g/10 min by standard techniques at a temperature of 190° C. with a 2.16 kg weight, and a melting point of 120–122° C. FUSABOND™ is a trademark of DuPont. ("EVOH").

The nylon 6 used in the following examples was CAPRON® 8202C obtained from Allied-Signal Inc. of Morristown, N.J. CAPRON(® is a registered trademark of Allied-Signal Inc. CAPRON® 8202C is a low viscosity, high crystallinity nylon 6 commonly used for injection molding. CAPRON® 8202C has a specific gravity of 1.13 g/cc and a melting point of 215° C. ("Nylon").

EXAMPLE 8

A melted blend of 3O% 4GT-6131, 15% 4GT-6130, 13% PEL, 19% PE, 19% PP, 1% EVOH, and 3% Nylon was injected into a continuous mixer and was mixed with $CO_2$ and water as described above. The polymer/$CO_2$ ratio in the mixer was 2.86 and the polymer/water ratio in the mixer was 1.25. The mixture was subsequently flash-spun from a 0.889 mm spinning orifice for approximately 15 minutes. A plexifilamentary fiber strand was obtained that had a tenacity of 2.2 gpd, an elongation of 61.5%, a toughness of 0.8 gpd, and a fiber quality rating of 2.25.

EXAMPLE 9

A melted blend of 18% 4GT-6131, 45% 4GT-6130, 12% PEL, 16% PE, 8% PP, and 1% EVOH was injected into a continuous mixer and was mixed with $CO_2$ and water as described above. The polymer/$CO_2$ ratio in the mixer was 1.25 and the polymer/water ratio in the mixer was 2.86. The mixture was subsequently flash-spun from a 0.889 mm spinning orifice for approximately 15 minutes. A plexifilamentary fiber strand was obtained that had a tenacity of 2.9 gpd, an elongation of 37%, a toughness of 0.6 gpd, and a fiber quality rating of 2.5.

EXAMPLE 10

A melted blend of 51% 4GT-6131, 16% 4GT-6130, 10% PEL, 12% PE, 10% PP, and 1% EVOH was injected into a continuous mixer and was mixed with $CO_2$ and water as described above. The polymer/$CO_2$ ratio in the mixer was 1.25 and the polymer/water ratio in the mixer was 2.86. The mixture was subsequently flash-spun from a 0.787 mm spinning orifice for approximately 15 minutes. A plexifilamentary fiber strand was obtained that had a tenacity of 2.8 gpd, an elongation of 62%, a toughness of 1.0 gpd, and a fiber quality rating of 2.2.

EXAMPLE 11

A melted blend of 82% PE, 9% PP, 4% PEL, and 5% EVOH was injected into a continuous mixer and was mixed with $CO_2$ and water as described above. The polymer/$CO_2$ ratio in the mixer was 1.25 and the polymer/water ratio in the mixer was 2.86. The mixture was subsequently flash-spun from a 35 mil (0.889 mm) spinning orifice for approximately 15 minutes. A plexifilamentary fiber strand was obtained that had a tenacity of 0.8 gpd, an elongation of 86%, a toughness of 0.4 gpd, and a fiber quality rating of 2.5.

It will be apparent to those skilled in the art that modifications and variations can be made the flash-spinning apparatus and process of this invention. The invention in its broader aspects is, therefore, not limited to the specific details or the illustrative examples described above. Thus, it is intended that all matter contained in the foregoing description, drawings and examples shall be interpreted as illustrative and not in a limiting sense.

We claim:

1. A plexifilamentary strand having a tensile strength of at least 1 gpd and a surface area, measured by the BET nitrogen adsorption method, greater than 2 $m^2/g$ comprising a three dimensional integral plexus of semicrystalline, polymeric, fibrous elements, said elements being co-extensively aligned with the network axis and having the structural configuration of oriented film-fibrils, said film-fibrils having a mean film thickness of less than 4 microns, a median fibril width of less than 25 microns, and being comprised of at least 20% by weight of polyethylene and polypropylene, wherein the polyethylene and polypropylene each comprise at least 5% by weight of each of the film-fibrils.

2. The plexifilamentary strand of claim 1 wherein each of said film-fibrils are comprised of at least 75% by weight of polyethylene and polypropylene.

3. The plexifilamentary strand of claim 2 wherein each of said film-fibrils are comprised of at least 90% by weight of polyethylene and polypropylene, and wherein the polyethylene and polypropylene each comprise at least 35% by weight of each of the film-fibrils.

4. The plexifilamentary strand of claim 3 wherein the polypropylene comprises at least 45% by weight of each of the film-fibrils.

5. The plexifilamentary strand of claim 3 wherein each of said film-fibrils are comprised of 100% by weight of polyethylene and polypropylene.

6. A bonded sheet comprised of the plexifilamentary strand material of claim 2.

7. A process for the production of flash-spun plexifilamentary film-fibril strands of a polymer that is comprised of at least 75% by weight of polyethylene and polypropylene, wherein the polyethylene and polypropylene each comprise at least 5% by weight of each of the film-fibrils; which comprises the steps of:

forming a spin solution of said polyethylene and polypropylene polymers in a solvent, said solvent having an atmospheric boiling point between 0° C. and 100° C., and being comprised of at least 50% of solvents selected from the group consisting of hydrocarbons, chlorinated hydrocarbons, hydrochlorofluorocarbons and alcohols; and spinning said spin solution at a pressure that is greater than the autogenous pressure of the spin solution into a region of lower pressure and at a temperature at least 50° C. higher than the atmospheric boiling point of the solvent.

8. The process of claim 7 wherein the polymer is comprised of at least 40% by weight polypropylene.

9. The process of claim 8 wherein the solvent is comprised of at least 80% by weight hydrocarbon solvent with a boiling point less than 50° C.

10. The process of claim 8 wherein the solvent comprises a blend of solvents in which at least 30% by weight of the solvent blend is selected from the group of methylene chloride, dichloroethylene and cyclopentane.

* * * * *